US009915916B2

(12) United States Patent
Mori et al.

(10) Patent No.: US 9,915,916 B2
(45) Date of Patent: Mar. 13, 2018

(54) PROCESS CARTRIDGE AND DRUM CARTRIDGE

(71) Applicant: BROTHER KOGYO KABUSHIKI KAISHA, Nagoya-shi, Aichi-ken (JP)

(72) Inventors: Hiroki Mori, Nagoya (JP); Hiromitsu Mizutani, Ichinomiya (JP); Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/454,026

(22) Filed: Mar. 9, 2017

(65) Prior Publication Data

US 2017/0336755 A1 Nov. 23, 2017

(30) Foreign Application Priority Data

May 20, 2016 (JP) ..... 2016-101564

(51) Int. Cl.
*G03G 21/16* (2006.01)
*G03G 21/18* (2006.01)

(52) U.S. Cl.
CPC ..... *G03G 21/1814* (2013.01); *G03G 21/1846* (2013.01); *G03G 21/1853* (2013.01)

(58) Field of Classification Search
CPC ..... G03G 21/1814; G03G 21/1821; G03G 21/1846; G03G 21/1853
See application file for complete search history.

(56) References Cited

U.S. PATENT DOCUMENTS 8,600,264 B2 * 12/2013 Hashimoto ..... G03G 21/1846 399/111
2002/0181968 A1 * 12/2002 Okimura ..... G03G 21/1807 399/111
2003/0228171 A1 * 12/2003 Miyabe ..... G03G 21/1814 399/111
2013/0051848 A1 2/2013 Itabashi et al.

FOREIGN PATENT DOCUMENTS

JP 2013-54060 A 3/2013
JP 2015-176117 A 10/2015

* cited by examiner

*Primary Examiner* — Hoang Ngo
(74) *Attorney, Agent, or Firm* — Merchant & Gould P.C.

(57) ABSTRACT

A developing frame has: side walls that support ends of a developing roller shaft; a connecting wall that connects the side walls, the connecting wall being pressed by first and second pressing members; and a handle extending from the connecting wall in a second direction perpendicular to a first direction. The handle is located farther away from the developing roller than the connecting wall is in the second direction. A drum frame has a supporting wall that supports the first and second pressing members. The supporting wall has an opening that is located between the first pressing member and the second pressing member. The opening allows the handle to be exposed when the developing cartridge is mounted on the drum cartridge. The supporting wall overlaps the handle as viewed from the first direction in a state where the handle is exposed through the opening.

16 Claims, 13 Drawing Sheets

PROCESS CARTRIDGE AND DRUM CARTRIDGE

CROSS REFERENCE TO RELATED APPLICATIONS

This application claims priority from Japanese Patent Application No. 2016-101564 filed May 20, 2016. The entire content of the priority application is incorporated herein by reference.

TECHNICAL FIELD

This disclosure relates to a process cartridge and a drum cartridge.

BACKGROUND

Conventionally, a process cartridge having a drum cartridge and having a developing cartridge detachably mounted on the drum cartridge is known.

This developing cartridge accommodates toner therein and has a handle to be gripped by a user.

SUMMARY

According to one aspect, this specification discloses a process cartridge. The process cartridge includes: a developing cartridge including: a developing roller having a shaft extending in a first direction; and a developing frame configured to accommodate toner; and a drum cartridge on which the developing cartridge is detachably mounted, the drum cartridge including: a photosensitive drum configured to contact the developing roller; a drum frame that supports the photosensitive drum; a first pressing member configured to press the developing cartridge toward the photosensitive drum; and a second pressing member configured to press the developing cartridge toward the photosensitive drum, the second pressing member being located spaced away from the first pressing member in the first direction. The developing frame has: a first side wall that supports one end of the shaft; a second side wall that supports an other end of the shaft; a connecting wall that connects the first side wall with the second side wall, the connecting wall being pressed by the first pressing member and the second pressing member; and a handle extending from the connecting wall in a second direction perpendicular to the first direction, the handle being located farther away from the developing roller than the connecting wall is in the second direction. The drum frame has a supporting wall that supports the first pressing member and the second pressing member. The supporting wall has an opening that is located between the first pressing member and the second pressing member, the opening being configured to allow the handle to be exposed when the developing cartridge is mounted on the drum cartridge.
The supporting wall is configured to overlap the handle as viewed from the first direction in a state where the handle is exposed through the opening.

According to another aspect, this specification also discloses a drum cartridge. The drum cartridge includes: a drum frame configured such that a developing cartridge is mounted thereon; a photosensitive drum that is rotatable about a rotational axis extending in a first direction, the photosensitive drum being provided at a one end portion of the drum frame in a second direction perpendicular to the first direction; a first pressing member being provided at an other end portion of the drum frame in the second direction, the first pressing member being configured to press the developing cartridge toward the photosensitive drum; and a second pressing member being provided at the other end portion of the drum frame in the second direction, the second pressing member being configured to press the developing cartridge toward the photosensitive drum, the second pressing member being located spaced away from the first pressing member in the first direction. The drum frame has a supporting wall that supports the first pressing member and the second pressing member. The supporting wall has an opening that is located between the first pressing member and the second pressing member in the first direction, the opening being configured to allow a handle of the developing cartridge to be exposed when the developing cartridge is mounted on the drum frame. The supporting wall is configured to overlap the handle of the developing cartridge as viewed from the first direction in a state where the handle of the developing cartridge is exposed through the opening.

According to still another aspect, this specification also discloses a drum cartridge. The drum cartridge includes: a photosensitive drum; a first spring for pressing a developing cartridge toward the photosensitive drum; a second spring for pressing the developing cartridge toward the photosensitive drum; and a supporting wall supporting the first spring and the second spring, the supporting wall having an opening that is located between the first spring and the second spring, the opening being recessed from one end edge of the supporting wall in a recessed direction. A length of the opening in the recessed direction is greater than or equal to 15 mm and less than or equal to 50 mm.

BRIEF DESCRIPTION OF THE DRAWINGS

Embodiments in accordance with this disclosure will be described in detail with reference to the following figures wherein.

DETAILED DESCRIPTION

In the above-mentioned process cartridge, it is desired that, when the developing cartridge is mounted on the drum cartridge, a user can easily grip the handle of the developing cartridge.

An example of an object of this disclosure is to provide a process cartridge and a drum cartridge that, when a developing cartridge is mounted on the drum cartridge, a user can easily grip a handle of the developing cartridge.

1. Outline of Developing Cartridge 1

The outline of a developing cartridge 1 will be described with reference to FIG. 1.

Figure 1:
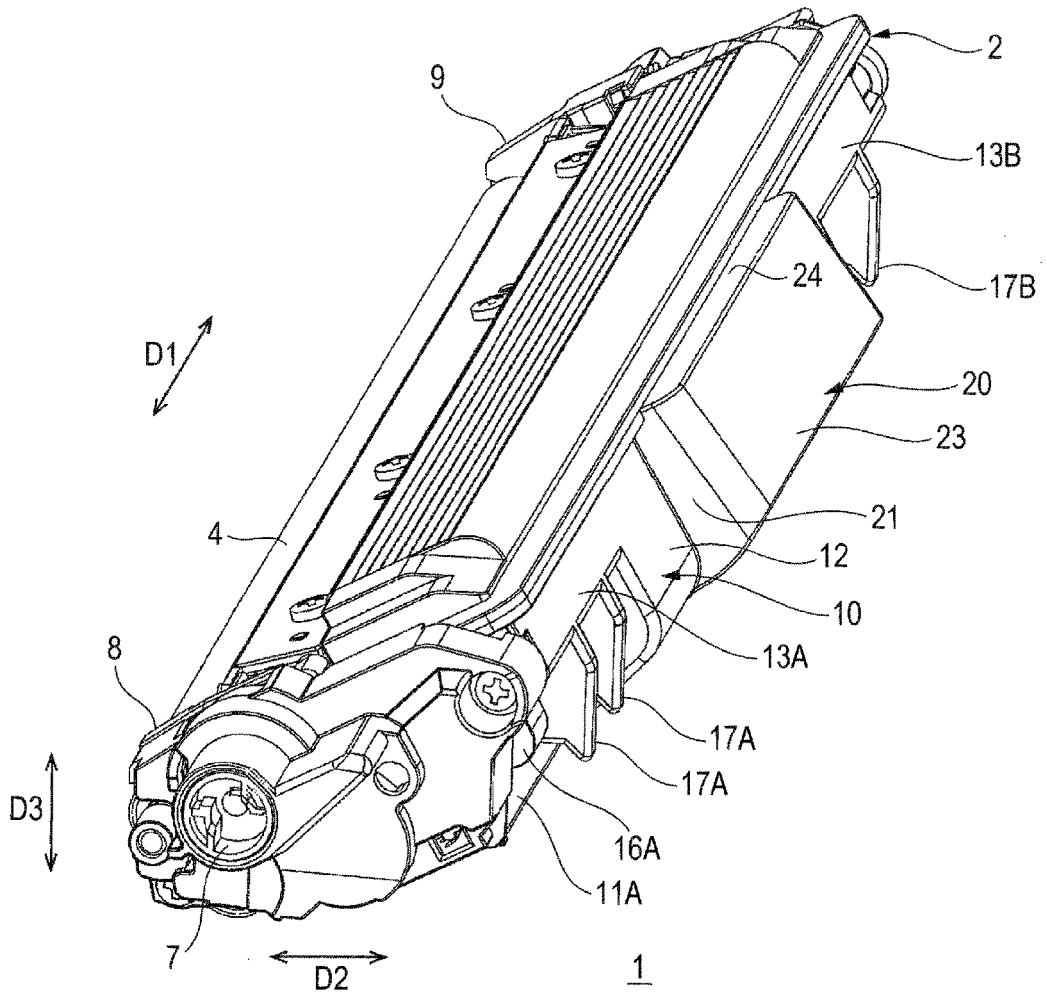
FIG. 1 is a perspective view of a developing cartridge according to an embodiment of this disclosure.

As shown in FIG. 1, the developing cartridge 1 includes a developing frame 2, a developing roller 4, an agitator 6 (see FIG. 3A), and a developing coupling 7.

1.1 Developing Frame 2

The developing frame 2 extends in a first direction D1. The developing frame 2 has a hollow and substantially rectangular tubular shape. The developing frame 2 can accommodate toner. In the following description, when the inside and the outside of the developing frame 2 is mentioned, a side in which toner is accommodated is the inside of the developing frame 2. Further, the opposite side of the inside in which the toner is accommodated, is the outside of the developing frame 2. In addition, a surface provided in the inside of the developing frame 2 is the inner surface of the developing frame 2 and a surface provided in the outside of the developing frame 2 is the outside of the developing frame 2.

1.2 Developing Roller 4

Figure 3A:
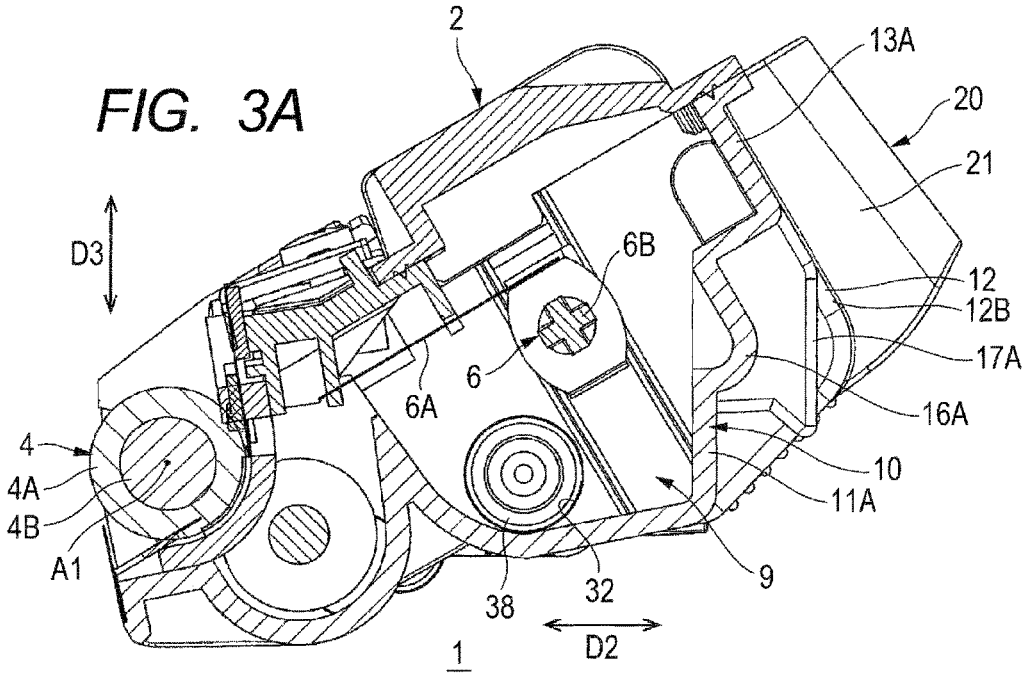
FIG. 3A is a cross-sectional view of the developing cartridge shown in FIG. 1, taken along a line passing through a first protruding portion.
Figure 3B:
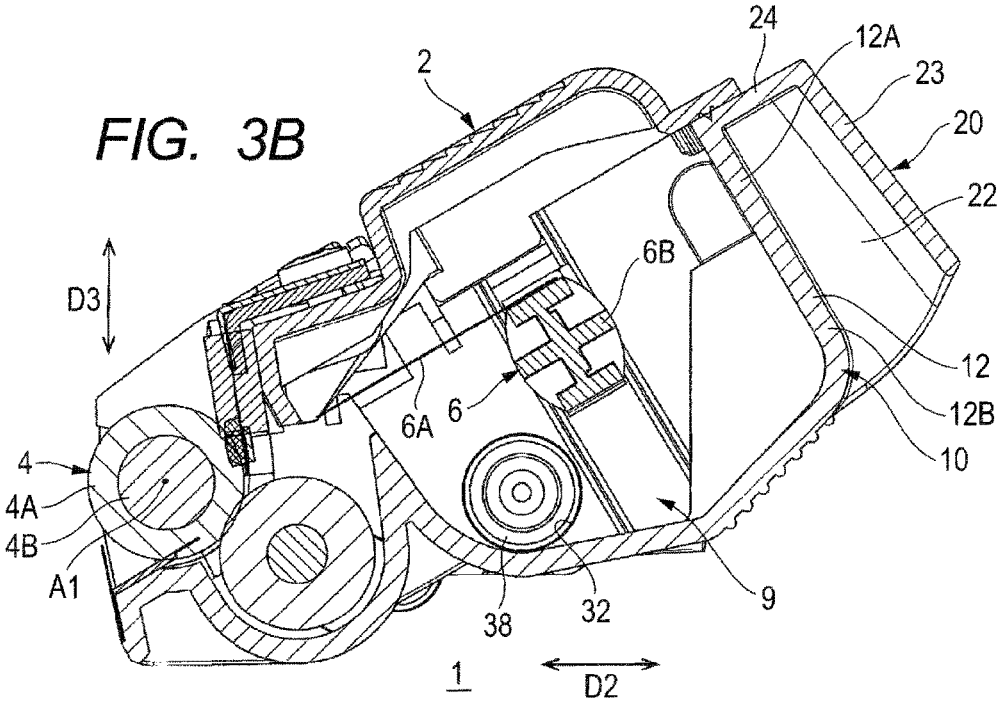
FIG. 3B is a cross-sectional view of the developing cartridge shown in FIG. 1, taken along a line passing through a second wall and a grip portion.
Figure 5:
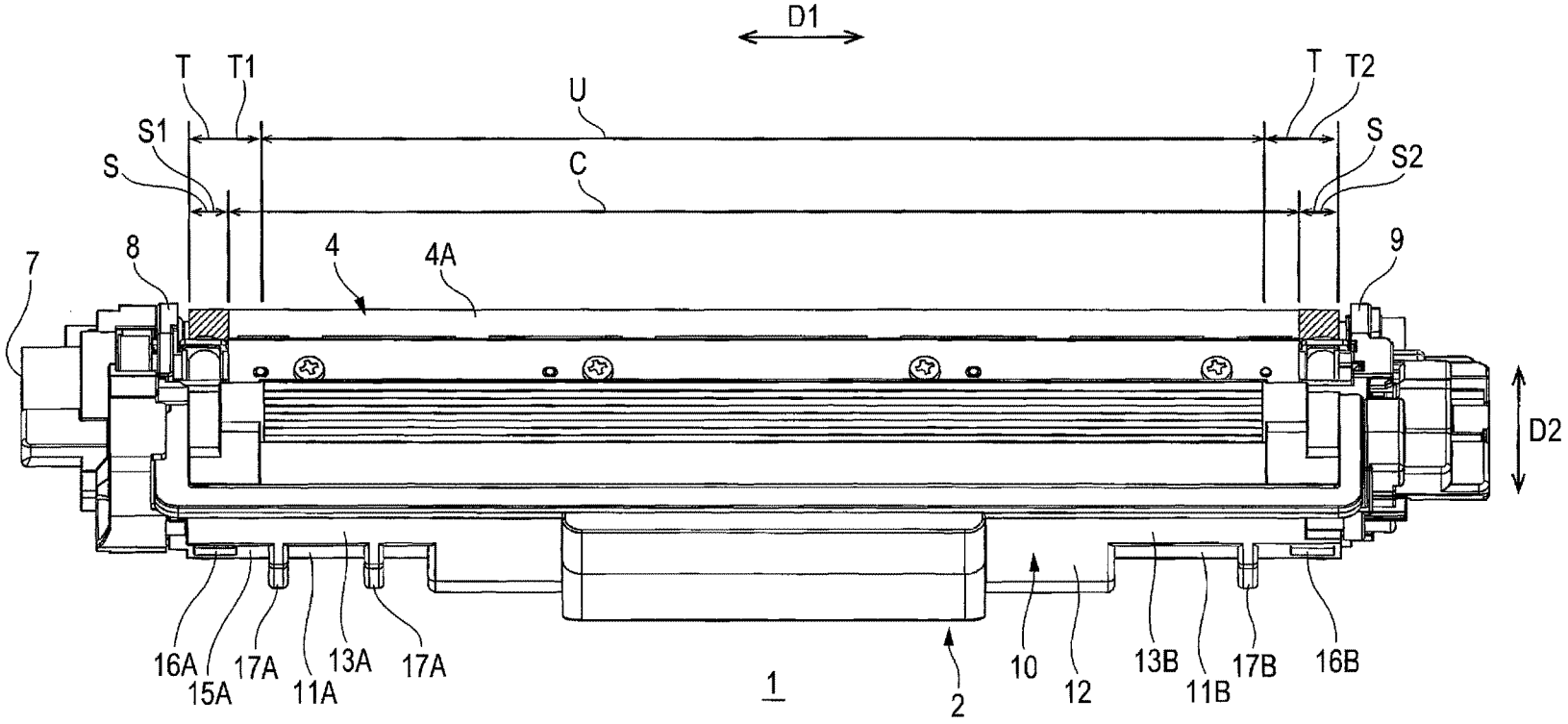
FIG. 5 is a side view for illustrating the developing roller of the developing cartridge shown in FIG. 1.

The developing roller 4 extends in the first direction D1. As shown in FIG. 3A and FIG. 3B, the developing roller 4 is rotatable about a rotational axis A1. The developing roller 4 is located at a one end portion in a second direction D2 perpendicular to the first direction D1 in the developing cartridge 1. The second direction D2 is a direction connecting the rotational axis A1 of the developing roller 4 with a rotational axis A2 of a photosensitive drum 44 described later. As shown in FIG. 3A and FIG. 5, a part of a peripheral surface of the developing roller 4 is exposed to the outside of the developing frame 2. The developing roller 4 includes a developing roller body portion 4A, and a shaft 4B.

As shown in FIG. 3A and FIG. 3B, the shaft 4B extends in the first direction D1. Both end portions of the shaft 4B in the first direction D1 are supported rotatably by the developing frame 2. The both end portions of the shaft 4B may be supported by the developing frame 2 via a bearing. In this embodiment, the shaft 4B extends over an entire length of the developing roller 4 in the axial direction (the first direction D1). However, the shaft may be another type of shaft that supports only both end portions of a hollow developing roller in the axial direction.

The developing roller body portion 4A extends in the first direction D1. The developing roller body portion 4A has a cylindrical shape. The developing roller body portion 4A is rotatable with the shaft 4B. As shown in FIG. 5, the developing roller body portion 4A has treatment regions T and an untreated region U.

The treatment regions T that does not supply toner to the photosensitive drum 44 described later. The treatment regions T are located at each of a one end portion and an other end portion in the first direction D1 in the developing roller body portion 4A. The treatment region T that is located at the one end portion in the first direction D1 of the developing roller body portion 4A is referred to as a treatment region T1 and the treatment region T that is located at the other end portion in the first direction D1 is referred to as a treatment region T2.

The untreated region U has larger surface roughness than that of the treatment regions T. The untreated region U is an area that supplies toner to the photosensitive drum 44. The untreated region U is located between the treatment region T1 and the treatment region T2 in the first direction D1. In the first direction D1, the length of the untreated region U is longer than the length of the treatment region T1. In addition, in the first direction D1, the length of the untreated region U is longer than the length of the treatment region T2.

The developing roller 4 is supported by the developing frame 2 in the one end portion and the other end portion of the shaft 4B in the first direction D1. Thus, the one end portion in the first direction D1 of the developing roller body portion 4A is hard to be deformed in the second direction D2. The center portion of the developing roller body portion 4A in the first direction D1 is easier to be deformed in the second direction D2 than the both end portions. In the developing roller body portion 4A, the region that is hard to be deformed is referred to as a straight region S and the region that is easier to be deformed than the straight region S is referred to as a curved region C.

The straight regions S are located at each of the one end portion and the other end portion of the shaft 4B in the first direction D1. In the first direction D1, the straight region S that is located at the one end portion of the developing roller 4 is referred to as a straight region S1, and the straight region S that is located at the other end portion is referred to as a straight region S2. In the first direction D1, the length of the straight region Si is shorter than the length of the treatment region T1. In the first direction D1, the length of the straight region S2 is shorter than the length of the treatment region T2.

The curved region C is located between the straight region Si and the straight region S2 in the first direction D1. In the first direction D1, the length of the curved region C is longer than the length of the straight region S1. In addition, in the first direction D1, the length of the curved region C is longer than the length of the straight region S2. In addition, in the first direction D1, the length of the curved region C is longer than the length of the untreated region U.

1.3 Agitator 6

Figure 6:
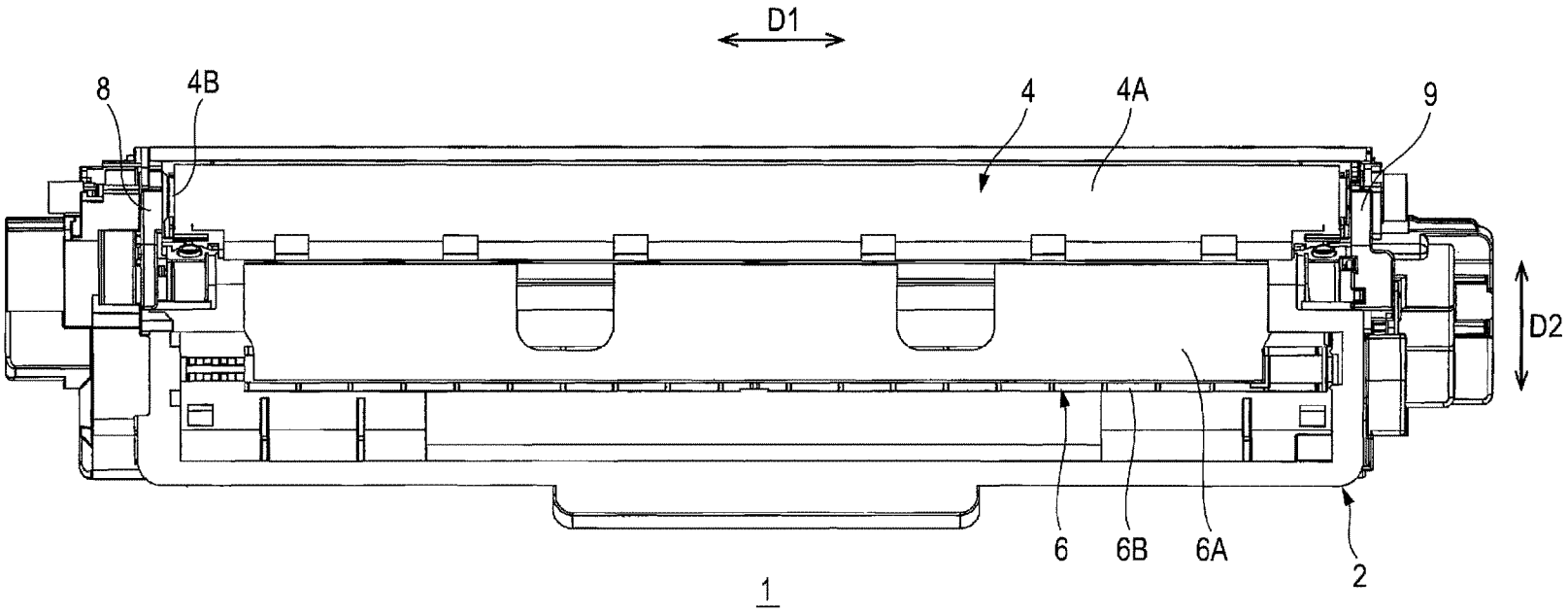
FIG. 6 is a side view for illustrating inside of a developing frame of the developing cartridge shown in FIG. 1.

As shown in FIG. 3A and FIG. 6, the agitator 6 extends in the first direction D1.

The agitator 6 is provided in the inside of the developing frame 2. The agitator 6 includes a blade 6A and an agitator shaft 6B. The agitator shaft 6B extends in the first direction D1. Both end portions of the agitator shaft 6B in the first direction D1 are supported rotatably by the developing frame 2. The blade 6A extends outward from the agitator shaft 6B in the radial direction of the agitator shaft 6B. The agitator 6 agitates toner in the developing frame 2 by rotation of the blade 6A in the developing frame 2. The agitator 6 conveys toner in the developing frame 2 to the developing roller 4.

1.4 Developing Coupling 7

Figure 2:
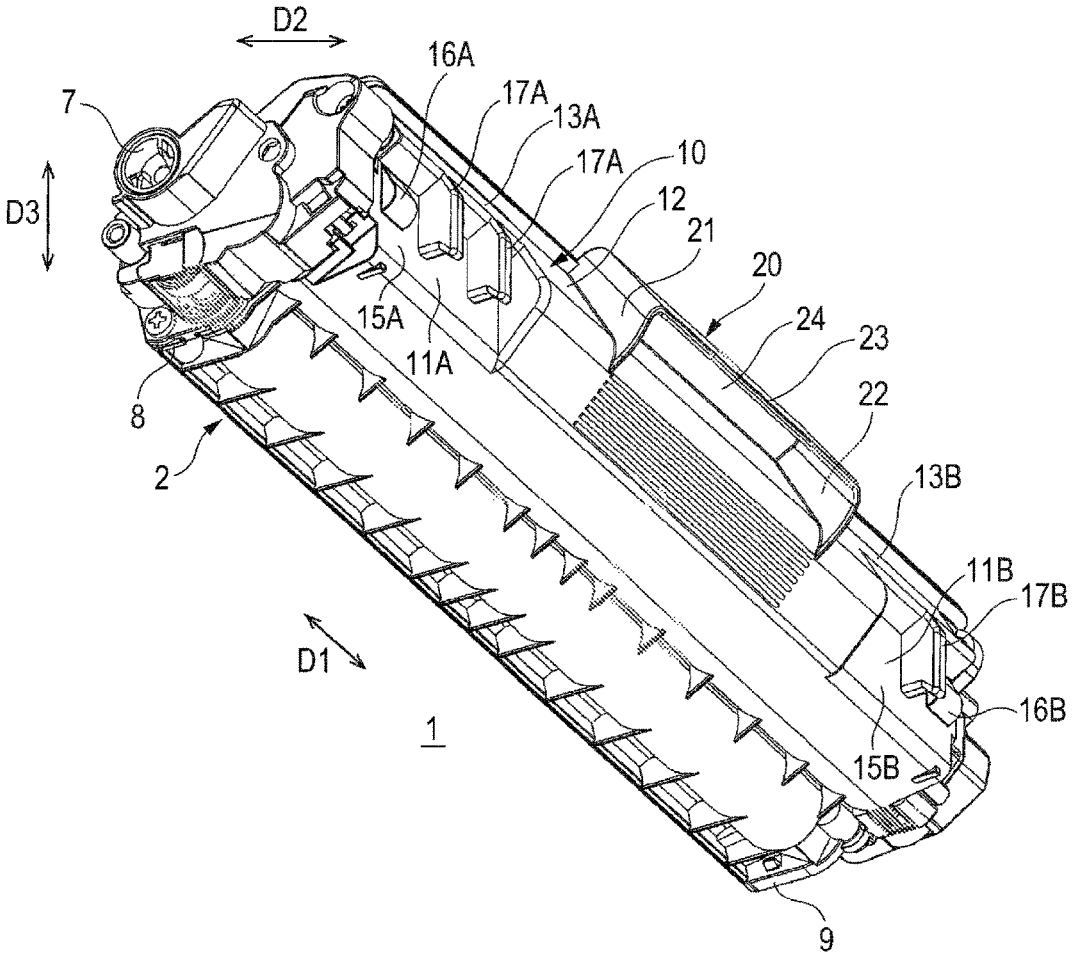
FIG. 2 is a perspective view of the developing cartridge shown in FIG. 1, as viewed from the opposite side.

As shown in FIG. 1 and FIG. 2, the developing coupling 7 is located at a one end portion of the developing cartridge 1 in the first direction D1. The developing coupling 7 receives the drive force from the outside and transmits the drive force to the developing roller 4 and the agitator 6.

2. Detail of Developing Frame 2

The developing frame 2 includes a first side wall 8, a second side wall 9, and a connecting wall 10.

2.1 First Side Wall 8 and Second Side Wall 9

As shown in FIG. 5 and FIG. 6, the first side wall 8 and the second side wall 9 are located spaced away from each other in the first direction D1. The first side wall 8 and the second side wall 9 extend in the second direction D2. The first side wall 8 and the second side wall 9 have a plate shape. The first side wall 8 supports the one end portion of the shaft 4B of the developing roller 4. The second side wall 9 supports the other end portion of the shaft 4B of the developing roller 4.

2.2 Connecting Wall 10

As shown in FIG. 3A and FIG. 3B, the connecting wall 10 is located at the opposite side from the developing roller 4 with respect to the agitator 6 in the second direction D2. The connecting wall 10 is located spaced away from the developing roller 4 in the second direction D2. As shown in FIG. 1 and FIG. 2, the connecting wall 10 is located between the first side wall 8 and the second side wall 9. The connecting wall 10 connects the first side wall 8 and the second side wall 9. The connecting wall 10 includes a receiving portion 11A, a receiving portion 11B, a protruding portion 12, an extending portion 13A, and an extending portion 13B, a protrusion 16A, a protrusion 16B, a plurality of ribs 17A, and a rib 17B.

2.2.1 Receiving Portion 11A, Receiving Portion 11B, and Protruding Portion The receiving portion 11A and the receiving portion 11B are located spaced away from each other in the first direction D1. The protruding portion 12 is located between the receiving portion 11A and the receiving portion 11B in the first direction D1.

The receiving portion 11A is located closer to the developing coupling 7 than the protruding portion 12 is in the first direction D1. The receiving portion 11A is located at a one end portion of the connecting wall 10 in the first direction D1. The receiving portion 11B is located at the opposite side from the receiving portion 11A with respect to the protruding portion 12 in the first direction D1. The receiving portion 11B is located at the other end portion of the connecting wall 10 in the first direction D1. The receiving portion 11A and the receiving portion 11B extend in the first direction D1. Each of the receiving portion 11A and the receiving portion 11B has a plate shape.

The protruding portion 12 is located at a position where the protruding portion 12 does not overlap the receiving portion 11A and the receiving portion 11B as viewed from the second direction D2. The protruding portion 12 is located at the center of the connecting wall 10 in the first direction D1. The protruding portion 12 extends in the first direction D1. As shown in FIG. 3A and FIG. 3B, the protruding portion 12 inclines relative to the receiving portion 11A and the receiving portion 11B. Specifically, the protruding portion 12 has a first end portion 12A and a second end portion 12B in a third direction D3 perpendicular to both of the first direction D1 and the second direction D2. The first end portion 12A is located at a one end portion that is away from the receiving portion 11A and the receiving portion 11B. The second end portion 12B is located at the other end portion that is opposite from the one end portion. When the developing cartridge 1 is mounted on a drum cartridge 41, the first end portion 12A is located at the opposite side from a bottom wall 49 (see FIG. 8A and FIG. 8B) with respect to the receiving portion 11A and the receiving portion 11B described later in the third direction D3. The second end portion 12B is located at the opposite side from the agitator 6 with respect to the receiving portion 11A and the receiving portion 11B in the second direction D2. The thickness of the protruding portion 12 is uniform from the first end portion 12A to the second end portion 12B. The protruding portion 12 is located farther away from the developing roller 4 than the receiving portion 11A and the receiving portion 11B are, in the second direction D2. The protruding portion 12 has a plate shape.

The inner surface of the protruding portion 12 is located farther away from the developing roller 4 than the inner surfaces of the receiving portion 11A and the receiving portion 11B are, in the second direction D2.

Figure 4:
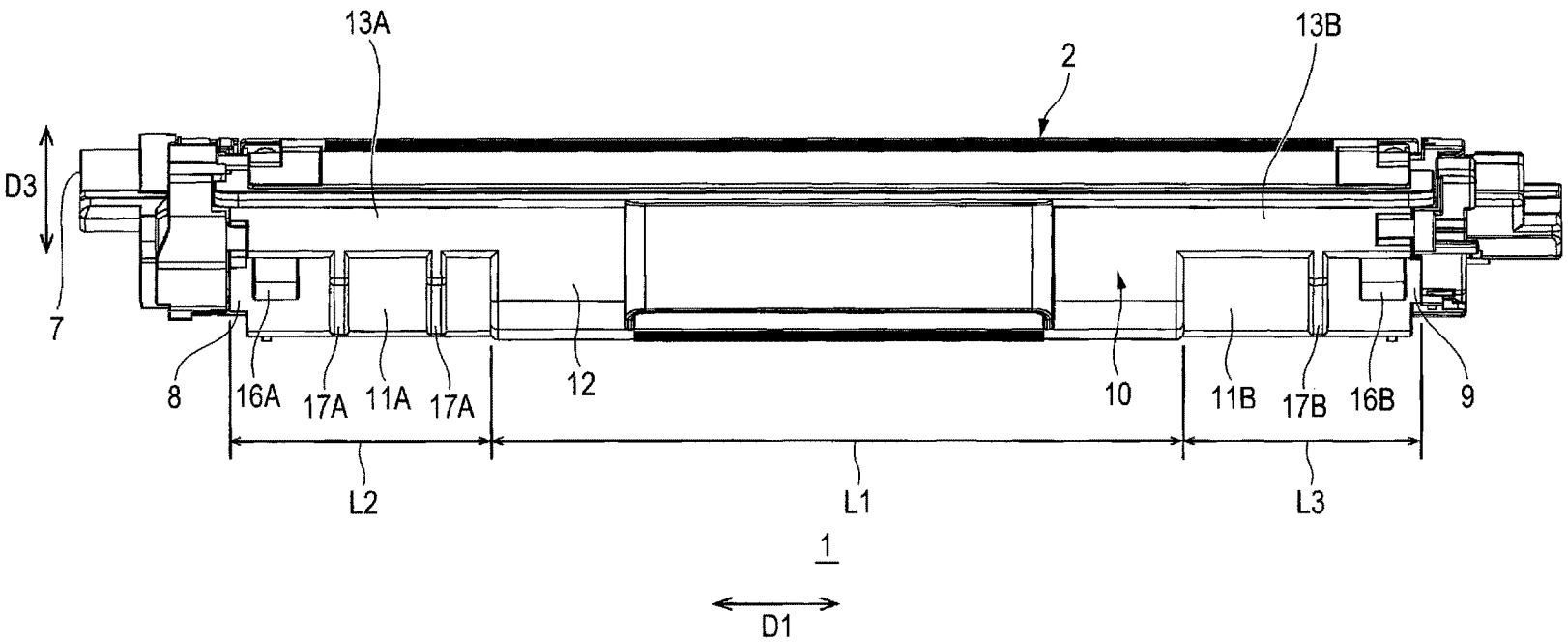
FIG. 4 is a side view of the developing cartridge shown in FIG. 1, as viewed from the opposite side of a developing roller.

In addition, as shown in FIG. 4, in the first direction D1, a length L1 of the protruding portion 12 is longer than a length L2 of the receiving portion 11A. In addition, in the first direction D1, the length L1 of the protruding portion 12 is longer than a length L3 of the receiving portion 11B. Specifically, in the first direction D1, the length L1 of the protruding portion 12 is greater than or equal to 1.5 times and preferably 2 times of the length L2 of the receiving portion 11A, for example, and is less than 3 times and preferably 2.5 times of the length L2 of the receiving portion 11A, for example. In addition, in the first direction D1, the length L1 of the protruding portion 12 is greater than or equal to 1.5 times and preferably 2 times of the length L3 of the receiving portion 11B, for example, and is less than 3 times and preferably 2.5 times of the length L3 of the receiving portion 11B, for example.

2.2.2 Extending portion 13A and Extending Portion 13B

The extending portion 13A and the extending portion 13B are located spaced away from each other in the first direction D1.

The extending portion 13A is located between the protruding portion 12 and the first side wall 8 in the first direction D1. The extending portion 13A is located at a one end portion of the connecting wall 10 in the first direction D1. The extending portion 13A is aligned with the receiving portion 11A in the third direction D3, as viewed from the second direction D2. Preferably, the extending portion 13A is located at an upper side of the receiving portion 11A.

The extending portion 13B is located between the protruding portion 12 and the second side wall 9 in the first direction D1. The extending portion 13B is located at the other end portion of the connecting wall 10 in the first direction D1. The extending portion 13B is aligned with the receiving portion 11B in the third direction D3, as viewed from the second direction D2. Preferably, the extending portion 13B is located at an upper side of the receiving portion 11B.

In this way, the extending portion 13A and the extending portion 13B are located at positions where the extending portions 13A and 13B does not overlap with the receiving portion 11A, the receiving portion 11B, and the protruding portion 12, as viewed from the second direction D2.

The extending portion 13A and the extending portion 13B extend in the first direction D1. As shown in FIG. 3A and FIG. 3B, the extending portion 13A and the extending portion 13B are aligned with the protruding portion 12 in the third direction D3. The extending portion 13A and the extending portion 13B are located farther away from the developing roller 4 than the receiving portion 11A and the receiving portion 11B are in the second direction D2.

Each of the extending portion 13A and the extending portion 13B has a plate shape. The inner surfaces of the extending portion 13A and the extending portion 13B are flush with the inner surface of the protruding portion 12. That is, the inner surfaces of the extending portion 13A and the extending portion 13B are located farther away from the developing roller 4 than the inner surfaces of the receiving portion 11A and the receiving portion 11B are in the second direction D2. The outer surfaces of the extending portion 13A and the extending portion 13B are flush with the outer surface of the protruding portion 12. The extending portion 13A and the extending portion 13B are parallel with the protruding portion 12.

2.2.3 Protrusion 16A and Protrusion 16B

As shown in FIG. 2 and FIG. 5, the protrusion 16A protrudes, in the second direction D2, from a supporting surface 15A of the receiving portion 11A toward the opposite side of the developing roller 4. In other words, the receiving portion 11A has the supporting surface 15A and the protrusion 16A. The protrusion 16A is located at the opposite side from the protruding portion 12 with respect to the plurality of ribs 17A described later, in the first direction D1. The protrusion 16A overlaps the treatment region T1 and the straight region S1 of the developing roller 4 as viewed from the second direction D2.

The protrusion 16B protrudes, in the second direction D2, from a supporting surface 15B of the receiving portion 11B toward the opposite side of the developing roller 4. In other words, the receiving portion 11B has the supporting surface 15B and the protrusion 16B. The protrusion 16B is located at the opposite side from the protruding portion 12 with respect to the rib 17B described later, in the first direction D1. The protrusion 16B overlaps the treatment region T2 and the straight region S2 of the developing roller 4, as viewed from the second direction D2.

As shown in FIG. 2 and FIG. 3A, the protrusion 16A and the protrusion 16B extend in the first direction D1. The outer surfaces of the protrusion 16A and the protrusion 16B are curved as viewed from the first direction D1.

As shown in FIG. 3A and FIG. 3B, the protrusion 16A and the protrusion 16B are located closer to the developing roller 4 than the inner surface of the second end portion 12B of the protruding portion 12 is in the second direction D2. In other words, the inner surface of the second end portion 12B of the protruding portion 12 is located farther away from the developing roller 4 than the protrusion 16A and the protrusion 16B are in the second direction D2.

Figure 7:
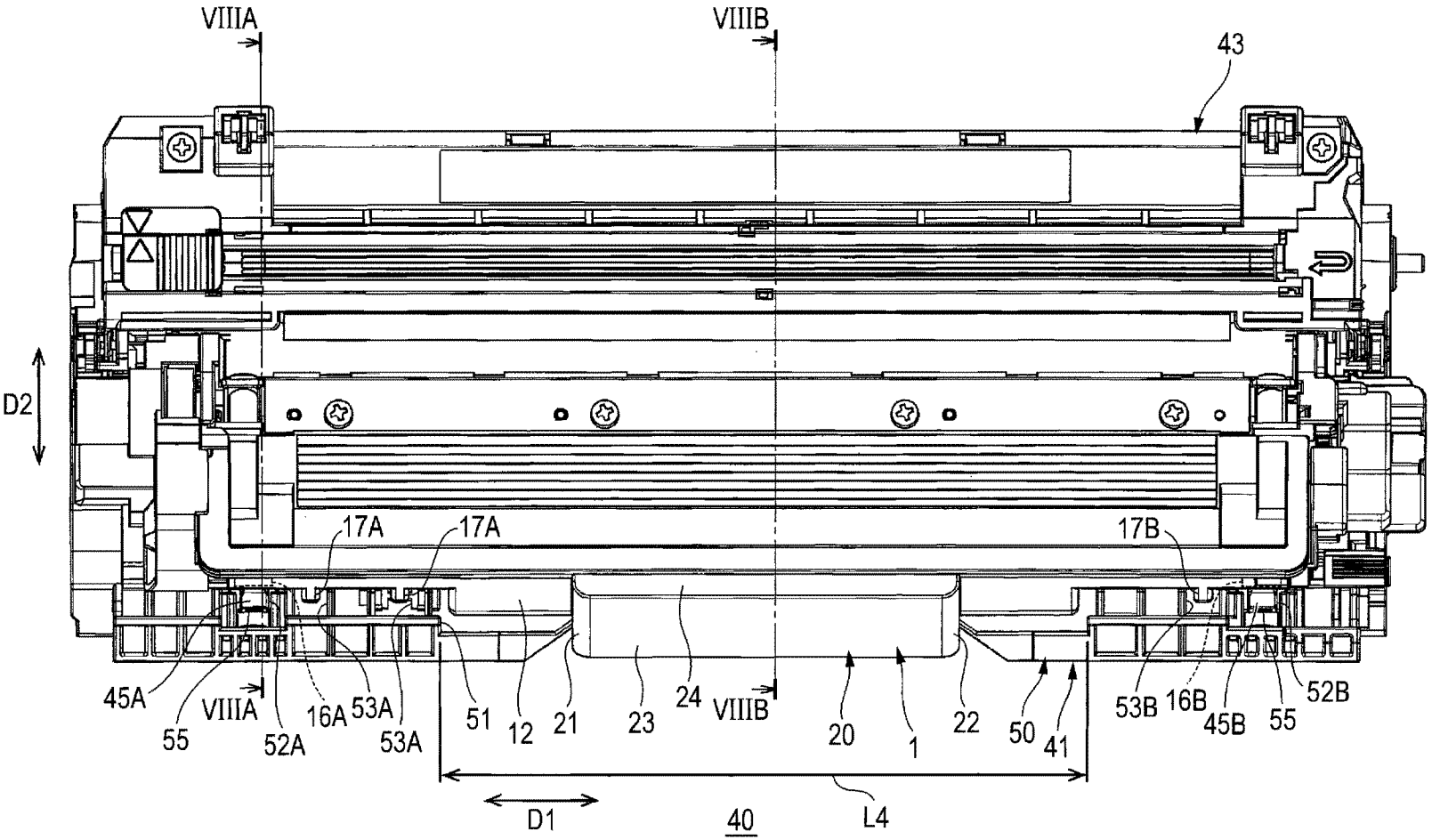
FIG. 7 is a side view of a process cartridge according to an embodiment of this disclosure.
Figure 8A:
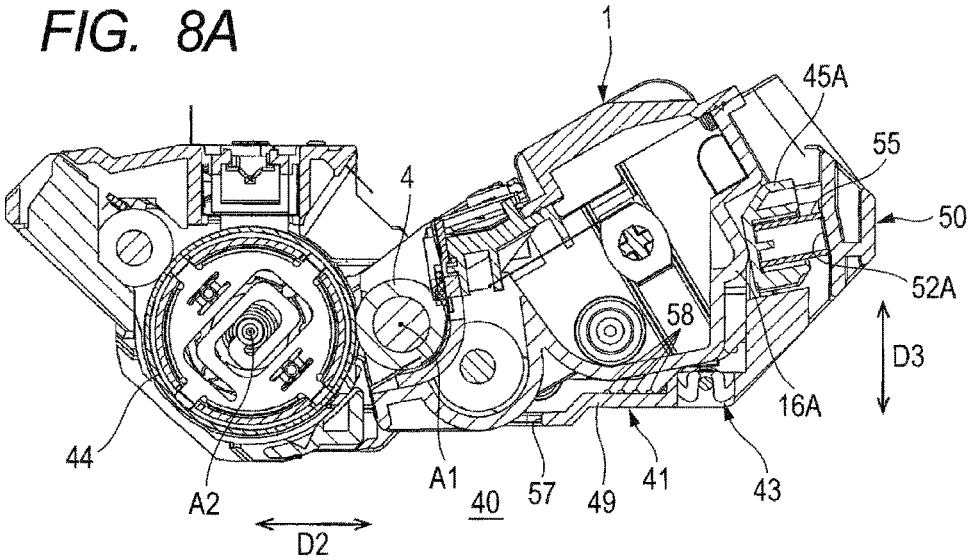
FIG. 8A is a cross-sectional view taken along a line VIIIA-VIIIA of FIG. 7.

As shown in FIG. 7 and FIG. 8A, the protrusion 16A receives pressing force in the second direction D2 from a first pressing member 45A of the drum cartridge 41 described later. The protrusion 16B receives pressing force in the second direction D2 from a second pressing member 45B of the drum cartridge 41 described later.

Moreover, the protrusion 16A receives the pressing force in the second direction D2 from the first pressing member 45A described later, and the protrusion 16B receives the pressing force in the second direction D2 from the second pressing member 45B described later. Thereby, the developing cartridge 1 is pressed by the photosensitive drum 44 described later.

2.2.4 Plurality of ribs 17A and rib 17B

As shown in FIG. 1 and FIG. 5, the ribs 17A protrude from the receiving portion 11A toward the opposite side of the developing roller 4 in the second direction D2. The ribs 17A protrude so as to be farther away from the developing roller 4 than the protrusion 16A is in the second direction D2. The ribs 17A extend in the third direction D3. Each of the ribs 17A has a plate shape. The plurality of ribs 17A is located spaced away from each other in the first direction D1. The plurality of ribs 17A are located between the protruding portion 12 and the protrusion 16A in the first direction D1. One end portions of the ribs 17A in the third direction D3 continue to the extending portion 13A.

The rib 17B protrudes from the receiving portion 11B toward the opposite side of the developing roller 4 in the second direction D2. The rib 17B protrudes so as to be farther away from the developing roller 4 than the protrusion 16B is in the second direction D2. The rib 17B extends in the third direction D3. The rib 17B has a plate shape. The rib 17B is located between the protruding portion 12 and the protrusion 16B in the first direction D1. One end portion of the rib 17B in the third direction D3 continues to the extending portion 13B.

As shown in FIG. 3A and FIG. 3B, the ribs 17A and the rib 17B are located closer to the developing roller 4 than the inner surface of the second end portion 12B of the protruding portion 12 is in the second direction D2. In other words, the inner surface of the second end portion 12B of the protruding portion 12 is located farther away from the developing roller 4 than the ribs 17A and the rib 17B are in the second direction D2.

2.3 Handle 20

As shown in FIG. 1 and FIG. 2, the developing frame 2 further includes a handle 20 to be gripped by a user.

The handle 20 is located farther away from the developing roller 4 than the protruding portion 12 is in the second direction D2. The handle 20 has a one end portion and an other end portion spaced away from the one end portion in the first direction D1. The handle 20 includes a first extending portion 21, a second extending portion 22, a first connecting portion 23 as an example of the connecting portion, and a second connecting portion 24.

As shown in FIG. 2 and FIG. 3A, the first extending portion 21 is located at the one end portion of the handle 20 in the first direction D1. The first extending portion 21 extends from the protruding portion 12 toward the opposite side of the developing roller 4 in the second direction D2. The first extending portion 21 has a plate shape.

As shown in FIG. 2 and FIG. 3B, the second extending portion 22 is located at the other end portion of the handle 20 in the first direction D1. The second extending portion 22 extends from the protruding portion 12 toward the opposite side of the developing roller 4 in the second direction D2. The second extending portion 22 has a plate shape.

The first connecting portion 23 is located spaced away from the protruding portion 12 in the second direction D2. The first connecting portion 23 extends in substantially parallel with the protruding portion 12. The first connecting portion 23 is located between the first extending portion 21 and the second extending portion 22. The first connecting portion 23 continues to the first extending portion 21 and the second extending portion 22.

The second connecting portion 24 is located at one end of the handle 20 in the third direction D3. The second connecting portion 24 is located between the protruding portion 12, the first extending portion 21, the second extending portion 22, and the first connecting portion 23. The second connecting portion 24 continues to the protruding portion 12, the first extending portion 21, the second extending portion 22, and the first connecting portion 23.

2.4 Other Configuration of Developing Frame 2

As shown in FIG. 3A and FIG. 3B, the second side wall 9 has a toner filling port 32.

The toner filling port 32 is formed through the second side wall 9 in the first direction D1. The toner filling port 32 is provided for filling toner in the developing frame 2. The toner filling port 32 has a substantially circular shape. A part of the peripheral edge of the toner filling port 32 coincides with the inner surface of the developing frame 2, as viewed from the first direction D1. The toner filling port 32 is closed by a cap 38 except when toner is filled in the developing frame 2.

3. Drum Cartridge 41

As shown in FIG. 7 and FIG. 8A, the developing cartridge 1 described above is mounted on the drum cartridge 41. The developing cartridge 1 forms a process cartridge 40 together with the drum cartridge 41.

The drum cartridge 41 includes a drum frame 43, the photosensitive drum 44, the first pressing member 45A, and the second pressing member 45B. The drum cartridge 41 has a one end portion and an other end portion in a perpendicular direction perpendicular to the axis direction of the photosensitive drum 44. The developing cartridge 1 is mounted on the drum cartridge 41 so that the first direction D1 coincides with the axis direction. At this time, the second direction D2 of the developing cartridge 1 coincides with the perpendicular direction of the drum cartridge 41.

3.1 Photosensitive Drum 44

Figure 8B:
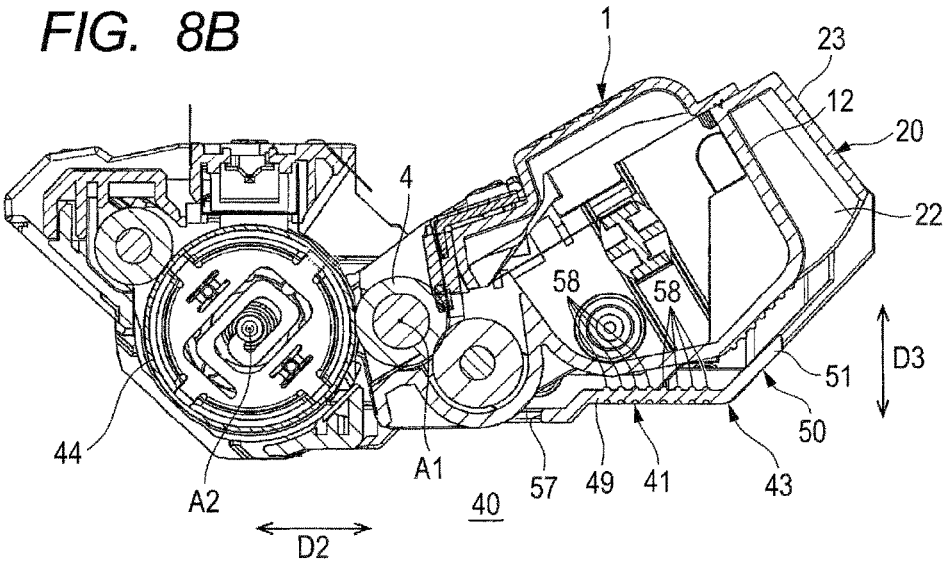
FIG. 8B is a cross-sectional view taken along a line VIIIB-VIIIB of FIG. 7.

As shown in FIG. 8A and FIG. 8B, the photosensitive drum 44 is located at the one end portion of the drum cartridge 41 in the second direction D2. The photosensitive drum 44 is rotatable about the rotational axis A2. The photosensitive drum 44 has a cylindrical shape.

3.2 Drum Frame 43

The drum frame 43 accommodates the developing cartridge 1 in between the photosensitive drum 44, the first pressing member 45A, and the second pressing member 45B.

Figure 9:
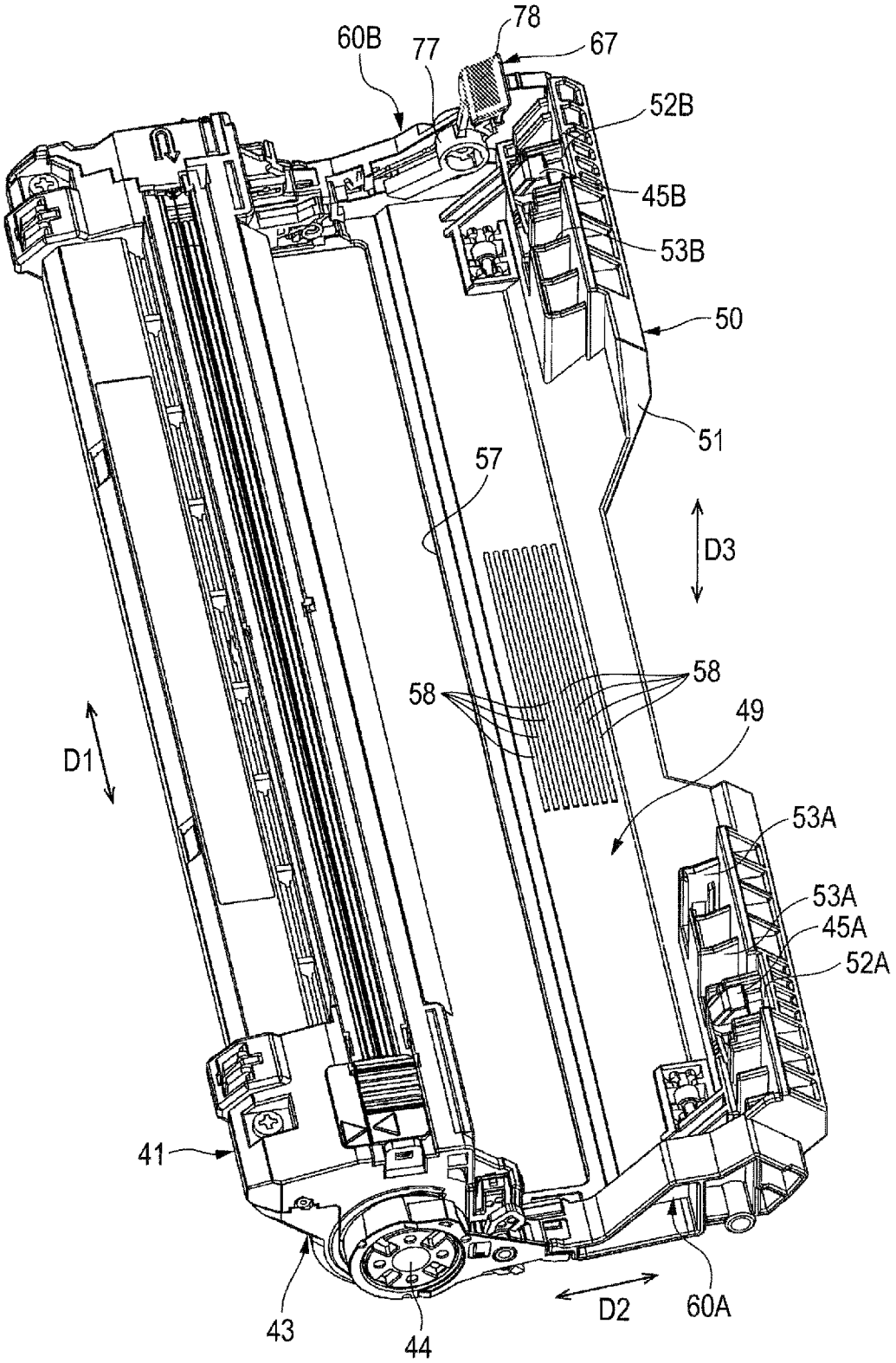
FIG. 9 is a perspective view of a drum cartridge of the process cartridge shown in FIG. 7.

As shown in FIG. 7 and FIG. 9, the drum frame 43 includes the bottom wall 49, a supporting wall 50, a first drum side wall 60A, and a second drum side wall 60B.

3.3 Bottom Wall 49

The bottom wall 49 extends in the first direction D1. As shown in FIG. 8A and FIG. 8B, the bottom wall 49 supports the developing cartridge 1 when the developing cartridge 1 is mounted on the drum cartridge 41.

The bottom wall 49 has an opening 57 and a plurality of ribs 58.

As shown in FIG. 8A and FIG. 9, the opening 57 is formed through the bottom wall 49 in the third direction D3. The opening 57 extends in the first direction D1. The opening 57 exposes the one end portion of the developing cartridge 1 when the developing cartridge 1 is mounted on the drum cartridge 41.

The plurality of ribs 58 is located between the opening 57 and an opening 51 of the supporting wall 50 in the second direction D2. The plurality of ribs 58 is located spaced away from each other in the second direction D2. The ribs 58 extend in the first direction D1. The plurality of ribs 58 faces the other end portion of the developing cartridge 1 when the developing cartridge 1 is mounted on the drum cartridge 41.

3.4 Supporting Wall 50

The supporting wall 50 is located at the other end portion of the drum frame 43 in the second direction D2. The supporting wall 50 is connected to the bottom wall 49. In other words, the bottom wall 49 is connected to the supporting wall 50. The supporting wall 50 extends in the first direction D1. The supporting wall 50 has a plate shape. The supporting wall 50 has a first supporting portion 52A and a second supporting portion 52B. The supporting wall 50 is a wall that connects the first drum side wall 60A and the second drum side wall 60B.

The first supporting portion 52A and the second supporting portion 52B are located at a one end portion and an other end portion of the supporting wall 50 respectively in the first direction D1. The first supporting portion 52A and the second supporting portion 52B are spaced away from each other in the first direction D1. The first supporting portion 52A supports the first pressing member 45A described later. The second supporting portion 52B supports the second pressing member 45B described later. As shown in FIG. 9, the first supporting portion 52A is connected to the first drum side wall 60A and the bottom wall 49. The second supporting portion 52B is connected to the second drum side wall 60B and the bottom wall 49.

3.4.1 Opening 51

The supporting wall 50 further has the opening 51. The opening 51 is located between the first supporting portion 52A and the second supporting portion 52B in the first direction D1. That is, the opening 51 does not overlap the first supporting portion 52A and the second supporting portion 52B as viewed from the second direction D2. As shown in FIG. 8B and FIG. 9, the opening 51 is recessed from the one end edge of the supporting wall 50 toward the other in the third direction D3. The opening 51 is a trapezoid shape as viewed from the second direction D2. The opening 51 is formed through the supporting wall 50 in the second direction D2. The opening 51 is surrounded by the first supporting portion 52A, the second supporting portion 52B, and the bottom wall 49. More specifically, three out of the four sides of the opening 51 is formed by edges of the first supporting portion 52A, the second supporting portion 52B, and the bottom wall 49; and the remaining one side is opened. The opening 51 receives the handle 20 when the developing cartridge 1 is mounted on the drum cartridge 41. The protruding portion 12 is located in the opening 51 as viewed from the second direction D2, when the developing cartridge 1 is mounted on the drum cartridge 41. The opening 51 overlaps the handle 20 as viewed from the second direction D2, when the developing cartridge 1 is mounted on the drum cartridge 41.

As shown in FIG. 7, a length L4 of the opening 51 is longer than the length of the handle 20 in the first direction D1. Preferably, the length L4 of the opening 51 is longer than the length L1 of the protruding portion 12 in the first direction D1. Further, the length L4 of the opening 51 is longer than the length of each of the first supporting portion 52A and the second supporting portion 52B in the first direction D1. In the third direction D3, the length of the opening 51 is greater than or equal to 15 mm and preferably greater than or equal to 25 mm, for example, and is less than or equal to 50 mm and preferably less than or equal to 40 mm, for example.

3.4.2 Plurality of Grooves 53A and Groove 53B

As shown in FIG. 7 and FIG. 9, the supporting wall 50 further has a plurality of grooves 53A and a groove 53B. Each of the plurality of grooves 53A and the groove 53B is recessed toward the direction away from the photosensitive drum 44. The plurality of grooves 53A and the groove 53B extend in the third direction D3.

The plurality of grooves 53A is located between the first supporting portion 52A and the opening 51 in the first direction D1. As shown in FIG. 7, each of the plurality of grooves 53A receives the corresponding rib 17A when the developing cartridge 1 is mounted on the drum cartridge 41.

The groove 53B is located between the second supporting portion 52B and the opening 51 in the first direction D1. The groove 53B receives the rib 17B when the developing cartridge 1 is mounted on the drum cartridge 41.

3.5 First Pressing Member 45A and Second Pressing Member 45B

As shown in FIG. 7 and FIG. 8A, the first pressing member 45A and the second pressing member 45B are located closer to the photosensitive drum 44 than the supporting wall 50 is in the second direction D2. As shown in FIG. 9, the first pressing member 45A is supported by the first supporting portion 52A. The second pressing member 45B is supported by the second supporting portion 52B.

As shown in FIG. 7 and FIG. 8A, a spring 55 is interposed between the first pressing member 45A and the first supporting portion 52A and between the second pressing member 45B and the second supporting portion 52B. The first pressing member 45A and the second pressing member 45B are normally urged toward the photosensitive drum by the spring 55. The end portion of the first pressing member 45A closer to the photosensitive drum 44 contacts the protrusion 16A in the second direction D2 when the developing cartridge 1 is mounted on the drum cartridge 41. The end portion of the second pressing member 45B closer to the photosensitive drum 44 contacts the protrusion 16B in the second direction D2 when the developing cartridge 1 is mounted on the drum cartridge 41. The first pressing member 45A and the second pressing member 45B press the developing cartridge 1 toward the photosensitive drum 44 when the developing cartridge 1 is mounted on the drum cartridge 41.

3.6 Other Configuration of Drum Cartridge 41

Figure 10:
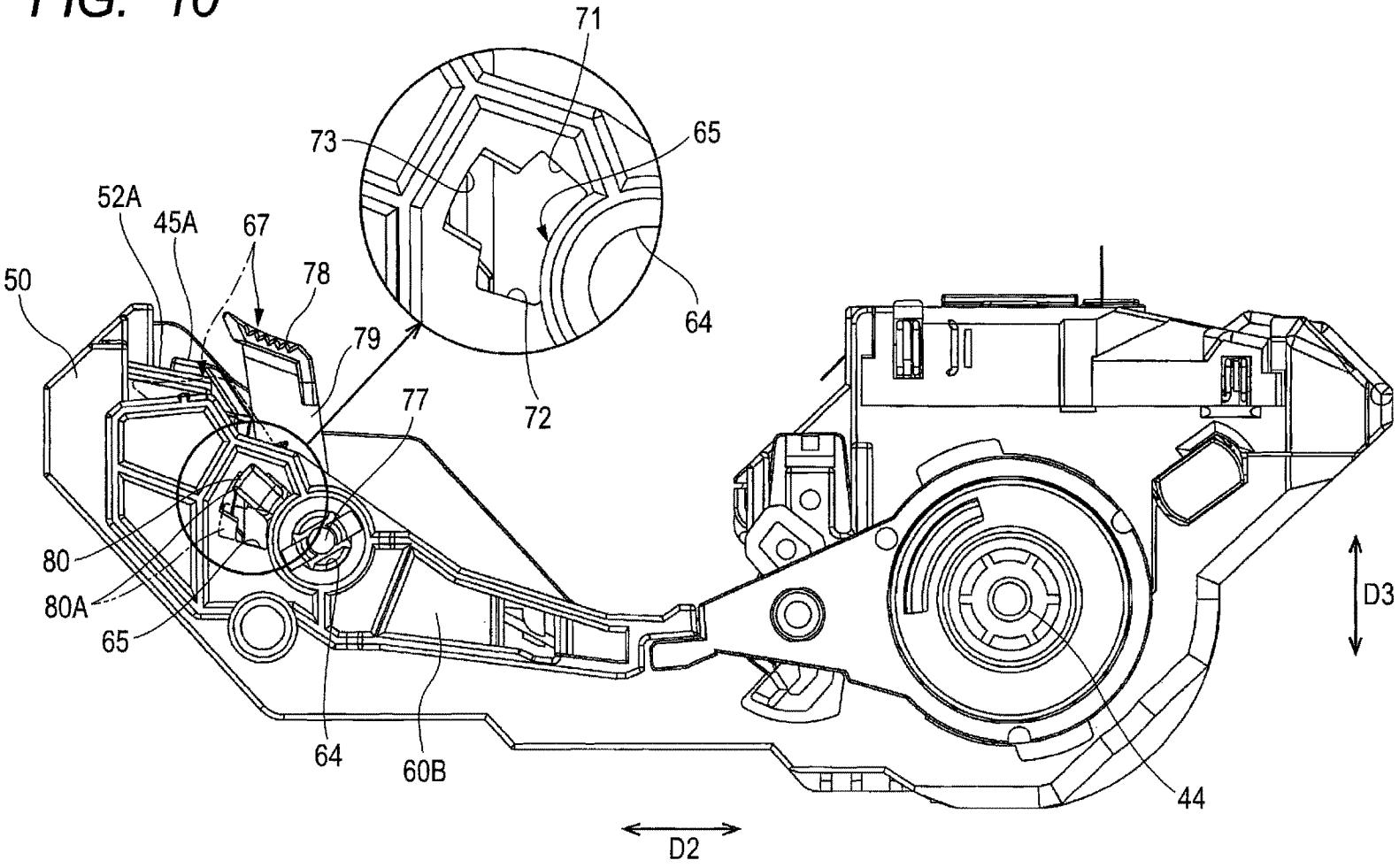
FIG. 10 is a side view for illustrating a switching member and a hole of the drum cartridge shown in FIG. 9.

As shown in FIG. 9 and FIG. 10, the drum cartridge 41 includes a switching member 67. The drum frame 43 has a hole 64 and a hole 65.

3.6.1 Switching Member 67

Figure 11B:
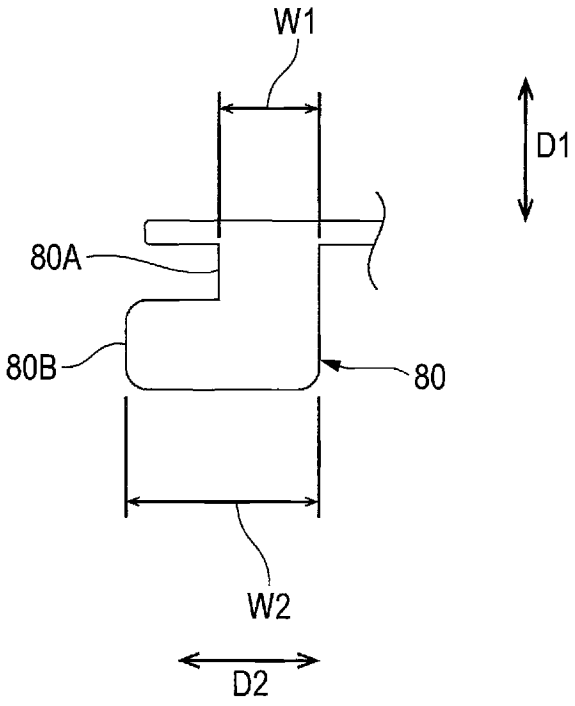
FIG. 11B is a cross-sectional view taken along a line XIB-XIB of FIG. 11A.
Figure 11A:
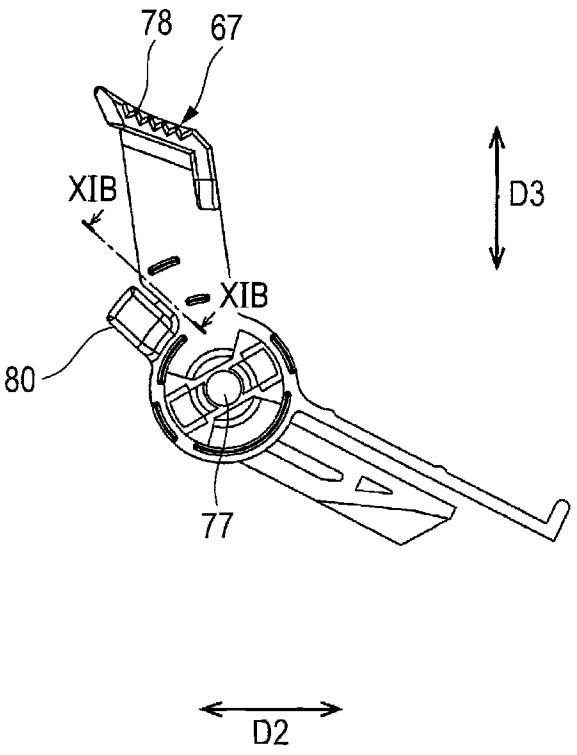
FIG. 11A is a side view of the switching member of the drum cartridge shown in FIG. 10.

The switching member 67 rotatably moves between a regulating position (see the solid line in FIG. 10) where the separation of the developing cartridge 1 with respect to the drum cartridge 41 is regulated and an allowable position (see the virtual line in FIG. 10) where the separation of the developing cartridge 1 with respect to the drum cartridge 41 is allowed. In the following description of the switching member 67, a state where the switching member 67 is located at the regulating position is taken as a reference. As shown in FIG. 11A and FIG. 11B, the switching member 67 includes a shaft 77, an operating portion 78 and a protrusion 80.

The shaft 77 extends in the axis direction. The shaft 77 has a cylindrical shape.

The operating portion 78 is located at a one end portion of the switching member 67. The operating portion 78 is operated by the user when the switching member 67 is rotatably moved from the regulating position (see the solid line in FIG. 10) to the allowable position (see the virtual line in FIG. 10).

The protrusion 80 is located between the shaft 77 and the operating portion 78. The protrusion 80 extends in the first direction D1. The protrusion 80 includes a base end portion 80A and a free end portion 80B.

The base end portion 80A is the other end portion of the protrusion 80 in the first direction D1.

The free end portion 80B is a one end portion in the axis direction of the protrusion 80. A width W2 of the free end portion 80B is larger than a width W1 of the base end portion 80A in the second direction D2.

3.6.2 Hole 64 and Hole 65

As shown in FIG. 10, the drum frame 43 has a wall facing the developing cartridge 1 in the first direction D1. The wall is located at the opposite side from the developing frame 2 with respect to the developing coupling 7 in the first direction D1. The wall has the hole 64 and the hole 65.

The hole 64 is located between the photosensitive drum 44 and the supporting wall 50 in the second direction D2. The hole 64 is formed through the wall of the drum frame 43 in the first direction D1. The hole 64 has a substantially circular shape. The hole 64 rotatably receives the shaft 77 of the switching member 67.

The hole 65 is provided in the same wall as the hole 64 in the drum frame 43. The hole 65 is located at the opposite side from the photosensitive drum 44 with respect to the hole 64 in the second direction D2. The hole 65 is formed through the drum frame 43 in the first direction D1. The hole 65 receives the protrusion 80 of the switching member 67. The hole 65 extends along a rotational locus of the protrusion 80 about the hole 64. The hole 65 includes a one end 71, an other end 72, and a wide portion 73.

The one end 71 is an end portion in which the protrusion 80 is located when the switching member 67 is located at the regulating position in the hole 65. The width of the one end 71 is larger than the width W1 of the base end portion 80A of the protrusion 80 and smaller than the width W2 of the free end portion 80B.

The other end 72 is an end in which the protrusion 80 is located when the switching member 67 is located at the allowable position in the hole 65. The width of the other end 72 is the same as the width of the one end 71.

The wide portion 73 is located between the one end 71 and the other end 72 in the hole 65. The width of the wide portion 73 is larger than the widths of the one end 71 and the other end 72, and the width W2 of the free end portion 80B.

4. Operations and Effects (1) According to the process cartridge 40, as shown in FIG. 7 and FIG. 8A, when the developing cartridge 1 is mounted on the drum cartridge 41, the developing cartridge 1 is pressed by the first pressing member 45A and the second pressing member 45B supported by the supporting wall 50, and thereby the developing cartridge 1 is pressed toward the photosensitive drum 44. The handle 20 of the developing cartridge 1 is exposed from the opening 51 of the supporting wall 50.

Therefore, the handle 20 of the developing cartridge 1 is exposed from the opening 51, while the first pressing member 45A and the second pressing member 45B can press the developing cartridge 1 reliably.

As a result, when the developing cartridge 1 is mounted on the drum cartridge 41, the user can grip the handle 20 of the developing cartridge 1 easily.

(2) According to the process cartridge 40, as shown in FIG. 7 and FIG. 8A, the developing cartridge 1 is reliably pressed toward the photosensitive drum 44 by two pressing members that are the first pressing member 45A and the second pressing member 45B.

(3) According to the process cartridge 40, as shown in FIG. 9, the plurality of ribs 58 of the bottom wall 49 of the drum cartridge 41 are located between the opening 51 of the supporting wall 50 and the opening 57 of the bottom wall 49.

Therefore, the user can easily access the plurality of ribs 58 via the opening 51 of the supporting wall 50 or the opening 57 of the bottom wall 49.

Therefore, the user can easily grip the drum cartridge 41 from which the developing cartridge 1 has been separated.

(4) According to the process cartridge 40, as shown in FIG. 7, in the first direction D1, the length L4 of the opening 51 is longer than the length of each of the first supporting portion 52A and the second supporting portion 52B, and thereby the handle 20 is exposed reliably from the opening 51.

(5) According to the process cartridge 40, as shown in FIG. 7 and FIG. 8B, when the developing cartridge 1 is mounted on the drum cartridge 41, the first connecting portion 23 of the handle 20 is located in the opening 51 of the drum frame 43 as viewed from the second direction D2.

Therefore, the user can grip the handle 20 easily from between the first extending portion 21, the second extending portion 22, and the first connecting portion 23 via the opening 51 of the drum frame 43.

(6) According to the process cartridge 40, as shown in FIG. 1 and FIG. 2, the handle 20 extends from the protruding portion 12 in the second direction D2, and thereby the user can grip the handle 20 more easily.

(7) According to the process cartridge 40, as shown in FIG. 2 and FIG. 3B, the protruding portion 12 is farther away from the developing roller 4 than the receiving portion 11A and the receiving portion 11B are in the second direction D2. Thereby, the volume of the developing frame 2 is increased when compared with a case where only the receiving portion 11A and the receiving portion 11B exit and the protruding portion 12 does not exist.

Therefore, the developing frame 2 can accommodate a large amount of toner in the inside.

(8) According to the process cartridge 40, as shown in FIG. 7 and FIG. 8A, the first pressing member 45A presses the protrusion 16A and the second pressing member 45B presses the protrusion 16B. Thereby, the developing cartridge 1 is pressed reliably toward the photosensitive drum 44.

In addition, as shown in FIG. 3A and FIG. 3B, the inner surface of the protruding portion 12 is farther away from the developing roller 4 than the protrusion 16A and the protrusion 16B are in the second direction D2, and thereby the volume of the developing frame 2 is increased.

(9) According to the process cartridge 40, as shown in FIG. 4, in the first direction D1, the length L1 of the protruding portion 12 is longer than each of the length L2 of the receiving portion 11A and the length L3 of the receiving portion 11B. Thereby, the protruding portion 12 can accommodate a larger amount of toner.

As a result, the volume of the developing frame 2 is further increased.

(10) By this drum cartridge 41, as shown in FIG. 7 and FIG. 8B, when the developing cartridge 1 is mounted on the drum cartridge 41, the handle 20 of the developing cartridge 1 is exposed from the opening 51 of the supporting wall 50 of the drum cartridge 41.

Therefore, the user can grip the handle 20 of the developing cartridge 1 easily when the developing cartridge 1 is mounted on the drum cartridge 41.

5. Modification

While the disclosure has been described in detail with reference to the above aspects thereof, it would be apparent to those skilled in the art that various changes and modifications may be made therein without departing from the scope of the claims.

Figure 12A:
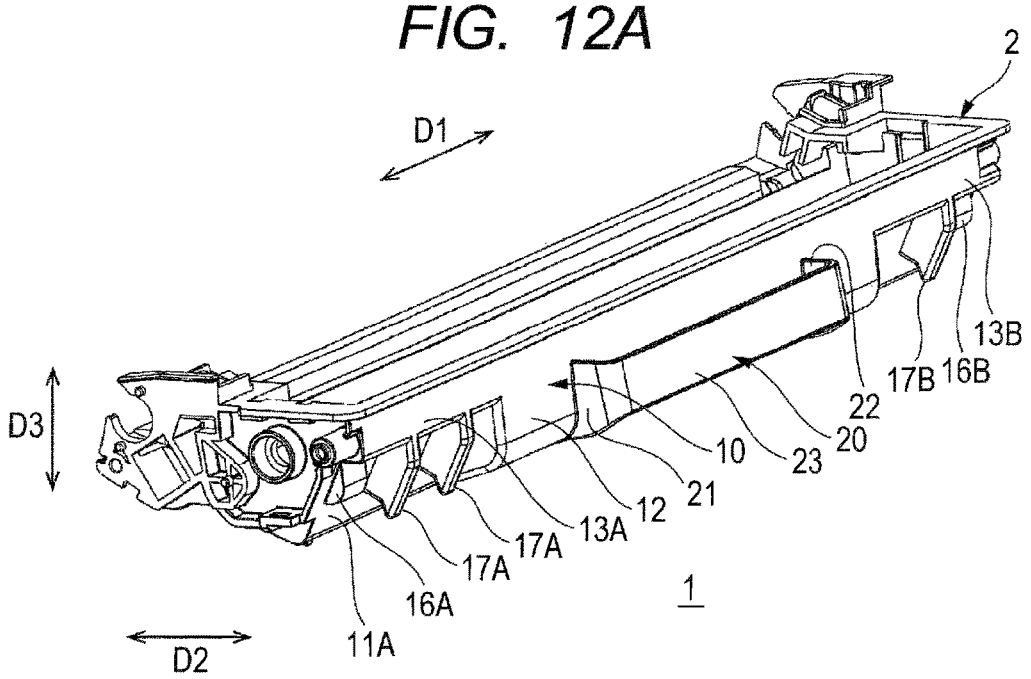
FIG. 12A is a perspective view of a developing cartridge according to a modification of this disclosure, in which a grip portion does not have second connecting portion and the grip portion is short.

(1) In the above-described embodiment, as shown in FIG. 1, the handle 20 includes the second connecting portion 24. However, as shown in FIG. 12A, the handle 20 need not necessarily include the second connecting portion 24, for example. In this case, in the third direction D3, the one end portions of the first extending portion 21, the second extending portion 22, and the first connecting portion 23 may be located at the other portions with respect to the above-described embodiment. In the modification shown in FIG. 12A, the first extending portion 21, the second extending portion 22, and the first connecting portion 23 are provided in the lower half of the connecting wall 10 in the third direction D3.

In such configuration, too, similar operation and effect to the above-described embodiment can be acquired.

Figure 12B:
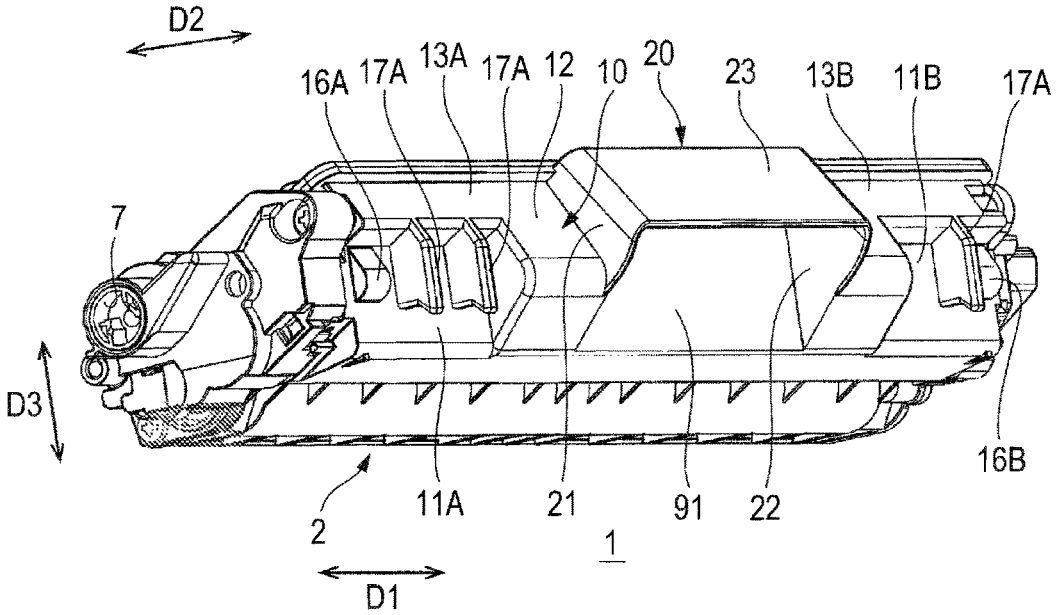
FIG. 12B is a perspective view of a developing cartridge according to another modification of this disclosure, in which a developing frame has a fourth frame in a grip portion.

(2) In the above-described embodiment, as shown in FIG. 2, the protruding portion 12 is located over between the one end portion and the other end portion of the handle 20 in the first direction D1. However, as shown in FIG. 12B, the developing frame 2 may include, between the one end portion and the other end portion of the handle 20, a recess 91 that is located closer to the developing roller 4 than the protruding portion 12 is in the second direction D2. The recess 91 is located at a position where the recess 91 does not overlap the protruding portion 12 as viewed from the second direction D2. The recess 91 extends in the first direction D1. The recess 91 is parallel with the receiving portion 11A and the receiving portion 11B.

By such configuration, the user can grip the handle 20 easily between the first extending portion 21, the second extending portion 22, the first connecting portion 23, and the recess 91.

In addition, similar operation and effect to the above-described embodiment can be acquired.

Figure 13A:
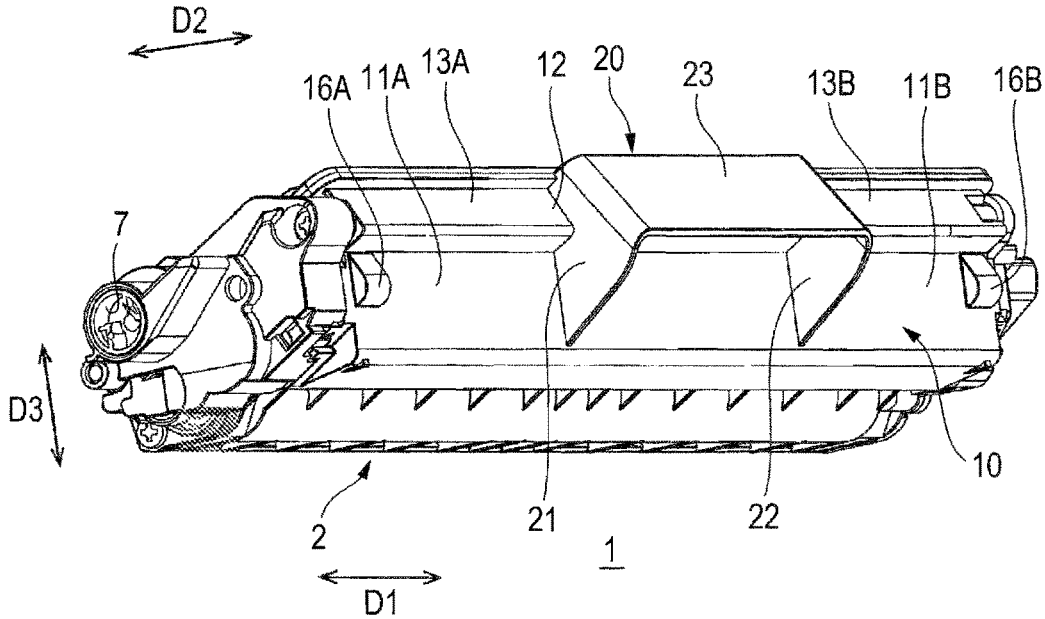
FIG. 13A is a perspective view of a developing cartridge according to still another modification of this disclosure, in which a second wall is partially omitted.

(3) In the above-described embodiment, as shown in FIG. 2, the protruding portion 12 is located between the receiving portion 11A and the receiving portion 11B in the first direction D1. However, as shown in FIG. 13A, the protruding portion 12 may be located only between the extending portion 13A and the extending portion 13B. In addition, the developing frame 2 need not necessarily include the ribs 17A and the rib 17B.

Figure 13B:
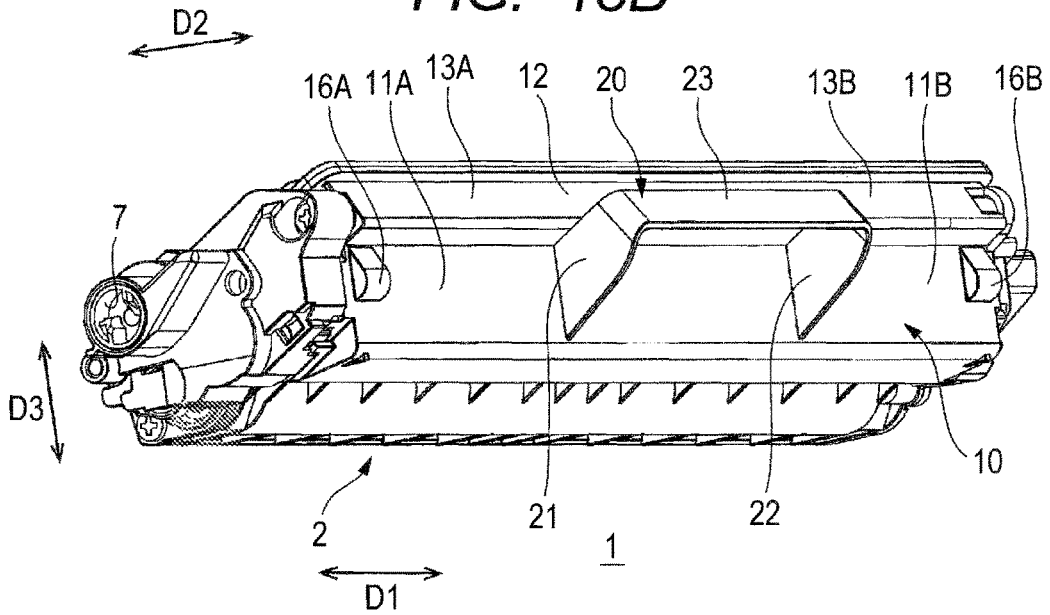
FIG. 13B is a perspective view of a developing cartridge according to still another modification of this disclosure, in which a grip portion is shorter than a grip portion of the developing cartridge of FIG. 13A.

Furthermore, as shown in FIG. 13B, in the third direction D3, the one end portions of the first extending portion 21, the second extending portion 22, and the first connecting portion 23 may be located at the other portions with respect to the above-described embodiment. In the modification shown in FIG. 13B, the first extending portion 21, the second extending portion 22, and the first connecting portion 23 are provided in the lower surface (the surface of the receiving portion 11A and the receiving portion 11B) of the connecting wall 10 in the third direction D3.

In this configuration, too, similar operation and effect to the above-described embodiment can be acquired.

(4) For example, the extending portion 13A may be located at the other side of the receiving portion 11A, and the extending potion 13B may be located at the other side of the receiving portion 11B. In other words, the extending portion 13A and the receiving portion 11A may be switched upside down, and the extending portion 13B and the receiving portion 11B may be switched upside down.

In this configuration, too, similar operation and effect to the above-described embodiment can be acquired.

What is claimed is:

1. A process cartridge comprising:

a developing cartridge comprising:

a developing roller having a shaft extending in a first direction; and a developing frame configured to accommodate toner; and a drum cartridge on which the developing cartridge is detachably mounted, the drum cartridge comprising:

a photosensitive drum configured to contact the developing roller;

a drum frame that supports the photosensitive drum;

a first pressing member configured to press the developing cartridge toward the photosensitive drum; and a second pressing member configured to press the developing cartridge toward the photosensitive drum, the second pressing member being located spaced away from the first pressing member in the first direction, the developing frame having:

a first side wall that supports one end of the shaft;

a second side wall that supports an other end of the shaft;

a connecting wall that connects the first side wall with the second side wall, the connecting wall being pressed by the first pressing member and the second pressing member; and a handle extending from the connecting wall in a second direction perpendicular to the first direction, the handle being located farther away from the developing roller than the connecting wall is in the second direction, the drum frame having a supporting wall that supports the first pressing member and the second pressing member, the supporting wall having an opening that is located between the first pressing member and the second pressing member, the opening being configured to allow the handle to be exposed when the developing cartridge is mounted on the drum cartridge, the supporting wall being configured to overlap the handle as viewed from the first direction in a state where the handle is exposed through the opening.

2. The process cartridge according to claim 1, wherein a length of the opening in a third direction perpendicular to both the first direction and the second direction is greater than or equal to 15 mm and less than or equal to 50 mm.

3. The process cartridge according to claim 1, wherein the drum frame has a bottom wall connected to the connecting wall, the bottom wall being configured to support the developing cartridge when the developing cartridge is mounted on the drum cartridge; and wherein the bottom wall has a rib extending in the first direction, the rib being located between the first pressing member and the second pressing member in the first direction.

4. The process cartridge according to claim 1, wherein the supporting wall has:

a first supporting portion that supports the first pressing member; and a second supporting portion that supports the second pressing member, the second supporting portion being located at an opposite side from the first supporting portion with respect to the opening in the first direction; and wherein a length of the opening in the first direction is greater than each of lengths of the first supporting portion and the second supporting portion in the first direction.

5. The process cartridge according to claim 1, wherein the handle has:

a first extending portion extending, in the second direction, from the connecting wall in a direction away from the developing roller;

a second extending portion extending, in the second direction, from the connecting wall in the direction away from the developing roller, the second extending portion being located spaced away from the first extending portion in the first direction; and a connecting portion extending in the first direction and connecting the first extending portion with the second extending portion, the connecting portion being located spaced away from the connecting wall in the second direction.

6. The process cartridge according to claim 1, wherein the connecting wall has:

a first receiving portion configured to be pressed by the first pressing member;

a second receiving portion configured to be pressed by the second pressing member; and a protruding portion located between the first receiving portion and the second receiving portion, the protruding portion being located farther away from the developing roller than the first and second receiving portions are in the second direction; and wherein the handle extends from the protruding portion in the second direction.

7. The process cartridge according to claim 6, wherein an inner surface of the protruding portion is located farther away from the developing roller than the first and second receiving portions are in the second direction.

8. The process cartridge according to claim 6, wherein each of the first receiving portion and the second receiving portion has:

a supporting surface; and a protrusion extending from the supporting surface in the second direction, the protrusion being located farther away from the developing roller than the supporting surface is in the second direction, the protrusion being configured to be pressed by a corresponding one of the first and second pressing members when the developing cartridge is mounted on the drum cartridge; and wherein an inner surface of the protruding portion is located farther away from the developing roller than the protrusion is in the second direction.

9. The process cartridge according to claim 6, wherein a length of the protruding portion in the first direction is greater than a length of the first and second receiving portions in the first direction.

10. The process cartridge according to claim 1, wherein the second direction is a direction connecting a rotational axis of the developing roller with a rotational axis of the photosensitive drum.

11. A drum cartridge comprising:

a drum frame configured such that a developing cartridge is mounted thereon;

a photosensitive drum that is rotatable about a rotational axis extending in a first direction, the photosensitive drum being provided at a one end portion of the drum frame in a second direction perpendicular to the first direction;

a first pressing member being provided at an other end portion of the drum frame in the second direction, the first pressing member being configured to press the developing cartridge toward the photosensitive drum; and a second pressing member being provided at the other end portion of the drum frame in the second direction, the second pressing member being configured to press the developing cartridge toward the photosensitive drum, the second pressing member being located spaced away from the first pressing member in the first direction, the drum frame having a supporting wall that supports the first pressing member and the second pressing member, the supporting wall having an opening that is located between the first pressing member and the second pressing member in the first direction, the opening being configured to allow a handle of the developing cartridge to be exposed when the developing cartridge is mounted on the drum frame, the supporting wall being configured to overlap the handle of the developing cartridge as viewed from the first direction in a state where the handle of the developing cartridge is exposed through the opening.

12. The drum cartridge according to claim 11, wherein a length of the opening in a third direction perpendicular to both the first direction and the second direction is greater than or equal to 15 mm and less than or equal to 50 mm.

13. The drum cartridge according to claim 11, wherein the drum frame has a bottom wall connected to the connecting wall, the bottom wall being configured to support the developing cartridge when the developing cartridge is mounted on the drum frame; and wherein the bottom wall has a rib extending in the first direction, the rib being located between the first pressing member and the second pressing member in the first direction.

14. The drum cartridge according to claim 11, wherein the supporting wall has:

a first supporting portion that supports the first pressing member; and a second supporting portion that supports the second pressing member, the second supporting portion being located at an opposite side from the first supporting portion with respect to the opening in the first direction; and wherein a length of the opening in the first direction is greater than each of lengths of the first supporting portion and the second supporting portion in the first direction.

15. A drum cartridge comprising:

a photosensitive drum;

a first spring for pressing a developing cartridge toward the photosensitive drum;

a second spring for pressing the developing cartridge toward the photosensitive drum; and a supporting wall supporting the first spring and the second spring, the supporting wall having an opening that is located between the first spring and the second spring, the opening being recessed from one end edge of the supporting wall in a recessed direction, wherein a length of the opening in the recessed direction is greater than or equal to 15 mm and less than or equal to 50 mm.

16. The drum cartridge according to claim 15, wherein the length of the opening in the recessed direction is greater than or equal to 25 mm and less than or equal to 40 mm.

* * * * *